US009307837B2

(12) United States Patent
Wood

(10) Patent No.: US 9,307,837 B2
(45) Date of Patent: Apr. 12, 2016

(54) CUSTOMIZABLE WALL CABINET FOR STORAGE OF PERSONAL ITEMS

(71) Applicant: Ronald Lynn Wood, Tempe, AZ (US)

(72) Inventor: Ronald Lynn Wood, Tempe, AZ (US)

( * ) Notice: Subject to any disclaimer, the term of this patent is extended or adjusted under 35 U.S.C. 154(b) by 0 days.

(21) Appl. No.: 14/727,612

(22) Filed: Jun. 1, 2015

(65) Prior Publication Data

US 2015/0374121 A1 Dec. 31, 2015

Related U.S. Application Data

(60) Provisional application No. 62/018,840, filed on Jun. 30, 2014.

(51) Int. Cl.

| | |
|---|---|
| ***A47B 67/02*** | (2006.01) |
| ***A47B 96/00*** | (2006.01) |
| ***A47B 96/04*** | (2006.01) |

(52) U.S. Cl.

CPC ..... *A47B 67/02* (2013.01); *A47B 96/00* (2013.01); *A47B 96/04* (2013.01)

(58) Field of Classification Search

CPC ..... A47B 67/00; A47B 67/02; A47B 96/04
USPC ..... 312/224, 225, 226, 227
See application file for complete search history.

(56) References Cited

U.S. PATENT DOCUMENTS

| | | | | |
|---|---|---|---|---|
| 742,012 | A | 10/1903 | Decker | |
| 891,389 | A | 6/1908 | Watts | |
| 2,346,316 | A | 4/1944 | Lumley | |
| 2,911,275 | A | 11/1959 | Wise | |
| 3,095,249 | A | 6/1963 | Albrecht | |
| 3,239,295 | A | 3/1966 | Simon | |
| 3,612,638 | A | 10/1971 | Francis | |
| 3,807,824 | A | 4/1974 | Hayes | |
| 3,872,342 | A | 3/1975 | Dankert | |
| 4,076,350 | A | 2/1978 | Crist | |
| 4,083,314 | A | 4/1978 | Garvin | |
| 4,134,625 | A | 1/1979 | Palka | |
| 4,236,772 | A | 12/1980 | Henson | |
| 4,304,447 | A | 12/1981 | Ellwood et al. | |
| 4,373,449 | A * | 2/1983 | Klaus | A47B 96/04 108/60 |
| 4,681,380 | A | 7/1987 | Carlin | |
| 4,776,650 | A | 10/1988 | Ferenzi | |
| 5,031,974 | A | 7/1991 | Feucht et al. | |
| 5,255,971 | A * | 10/1993 | Aisley | A47B 67/02 312/242 |
| 5,401,094 | A | 3/1995 | Walsten | |
| 5,405,196 | A * | 4/1995 | Shoup | A47B 96/061 248/488 |
| 5,511,873 | A * | 4/1996 | Mech | A45C 11/16 206/566 |
| 5,524,980 | A * | 6/1996 | Carter | A47B 96/00 211/88.01 |

(Continued)

*Primary Examiner* — Daniel Rohrhoff

(74) *Attorney, Agent, or Firm* — IDP Patent Services; Olav M. Underdal

(57) ABSTRACT

A partially recessed, fully enclosed wall cabinet for storage of water closet personal items is disclosed. The wall cabinet described here is specifically designed to accommodate the size, shape, and quantity of personal items needed for access by a person sitting on the toilet. It uses empty space between wall studs to provide storage volume for personal items, but extends the storage volume slightly outward into the water closet area in order to enable storage of such items without deformation. The user may configure the dividers to provide a customized configuration of storage compartments. The outer doors of the invention keep all stored contents protected from general view as well as contamination, but allow simple access. The invention also enables exchange of the dividers for a trash receptacle for discrete, enclosed disposal of non-flushable items.

18 Claims, 11 Drawing Sheets

FIG. 3

(56) References Cited

U.S. PATENT DOCUMENTS

| | | | | | |
|---|---|---|---|---|---|
| 5,577,819 | A | | 11/1996 | Olsen | |
| 5,707,125 | A | | 1/1998 | Coglin | |
| 5,845,980 | A | | 12/1998 | Fricano et al. | |
| 5,848,711 | A | | 12/1998 | Schmit | |
| 5,882,094 | A | | 3/1999 | Parsley | |
| 5,924,781 | A | | 7/1999 | Mitchell | |
| 5,954,411 | A | * | 9/1999 | Katz | A47B 67/02 312/224 |
| 5,997,112 | A | | 12/1999 | Karten et al. | |
| 6,089,685 | A | * | 7/2000 | Ryan | A47B 57/10 312/291 |
| 6,099,095 | A | | 8/2000 | Irace | |
| 6,129,431 | A | | 10/2000 | Hansen et al. | |
| 6,163,898 | A | * | 12/2000 | Misch | E03D 9/085 4/420.4 |
| 7,963,621 | B1 | | 6/2011 | Ellis | |
| 8,118,168 | B2 | | 2/2012 | Holloway et al. | |
| 2003/0042828 | A1 | * | 3/2003 | Bonin | A47B 67/02 312/245 |
| 2005/0109722 | A1 | * | 5/2005 | Golias, Jr. | A47B 96/04 211/135 |
| 2006/0006772 | A1 | * | 1/2006 | Galindo | A47B 67/005 312/227 |
| 2007/0164643 | A1 | * | 7/2007 | Greiner | A45C 11/16 312/227 |
| 2009/0189497 | A1 | | 7/2009 | Stenbakken | |
| 2010/0231099 | A1 | * | 9/2010 | Forrest | A47B 96/04 312/211 |
| 2012/0200211 | A1 | | 8/2012 | Yanni | |
| 2012/0206026 | A1 | | 8/2012 | Emelio | |
| 2012/0223626 | A1 | | 9/2012 | Thomas | |
| 2013/0113350 | A1 | | 5/2013 | Lee | |

* cited by examiner

CUSTOMIZABLE WALL CABINET FOR STORAGE OF PERSONAL ITEMS

CROSS-REFERENCE TO RELATED APPLICATIONS

This application claims benefit of U.S. Provisional Application No. 62/018,840, filed Jun. 30, 2014.

FIELD OF THE INVENTION

The present invention relates generally to the field of wall cabinets and more particularly to methods and systems for wall cabinets adapted for use in water closets.

BACKGROUND OF THE INVENTION

Water closets in homes lack a method to conveniently store, protect, and access personal items needed while sitting on the toilet. Examples of such personal items include spare toilet paper rolls, moistened wipes, sanitary napkins/tampons, napkin/tampon disposable bags, lotions/sprays, air fresheners/deodorizers, and urinary catheters.

Either storage is non-existent or the design results in one or more of the following: items are unprotected and subject to contamination; items are enclosed but visible; items are inaccessible while sitting on the toilet; or the storage system excessively protrudes into otherwise usable space. For shelving or cabinet systems behind and above the toilet, a user may have to stand up and rotate to access the storage. In the case of storage systems located elsewhere, but not within reach of the person on the toilet, a user may have to venture away from the toilet.

In addition, current storage systems are not designed for the shape, size, quantity, and use of many personal items. Examples include storage of multiple spare rolls of toilet paper in a manner not requiring excessive deformation of those rolls, and storage of personal items and original containers/packaging without deformation. In addition, current storage systems do not partition the storage volume into customized, reconfigurable compartments.

Furthermore, toilet users need to dispose of non-flushable items. Examples include empty toilet paper rolls, moistened wipes, sanitary napkins/tampons, and catheters. Often, a trash receptacle is either non-existent or is not within reach while sitting on the toilet. Furthermore, receptacles are frequently placed on the floor and are of an open container design. In such cases, the result is useable space consumed, and an opportunity for pets or young children to access the refuse. Lastly, trash receptacles often use disposable liners that are specific to each receptacle.

As such, considering the foregoing, it may be appreciated that there continues to be a need for novel and improved devices and methods for securing storage space in close proximity of a toilet.

SUMMARY OF THE INVENTION

The foregoing needs are met, to a great extent, by the present invention, wherein in aspects of this invention, enhancements are provided to the existing model of wall cabinets for use in a water closet.

In an aspect, the customizable wall cabinet described here is specifically designed to accommodate the size, shape, and quantity of personal items needed for access by a person sitting on a toilet.

In a related aspect, the customizable wall cabinet uses empty space between wall studs to provide storage volume for personal items, but extends the storage volume slightly outward into the water closet area in order to enable storage of such items without deformation. Accordingly, the customizable wall cabinet is only partially recessed into the wall.

In another related aspect, the depth of the customizable wall cabinet and the profile of the doors and dividers enable storage of up to nine large rolls of toilet paper, with each roll stored in a vertical orientation. The shape and dimensions of the customizable wall cabinet, as well as interlocking dividers, also allow for storage of other personal items in their original boxes/packaging. The user may configure the dividers to provide a customized configuration of storage compartments.

In yet a related aspect, the outer doors of the customizable wall cabinet keep all stored contents protected from general view as well as contamination, but allow simple access. The customizable wall cabinet can also enable replacement of the dividers for a trash receptacle for discrete, enclosed disposal of non-flushable items. The design of the trash receptacle can allow the use of ordinary grocery store plastic bags as liners.

In yet another related aspect, the customizable wall cabinet provides enclosed, protected storage of personal items in an easily accessible manner, for use while a person is sitting on the toilet. When the doors of the customizable wall cabinet are closed, personal items are protected from contamination and remain outside of view.

In a further related aspect, once installed, the customizable wall cabinet is partially recessed into the wall of the water closet. Due to the resulting minimal protrusion into the volume of the water closet space, the customizable wall cabinet may be placed in a user-determined location within reach of the toilet.

There has thus been outlined, rather broadly, certain embodiments of the invention in order that the detailed description thereof herein may be better understood, and in order that the present contribution to the art may be better appreciated. There are, of course, additional embodiments of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of embodiments in addition to those described and of being practiced and carried out in various ways. In addition, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION

Figure 1:
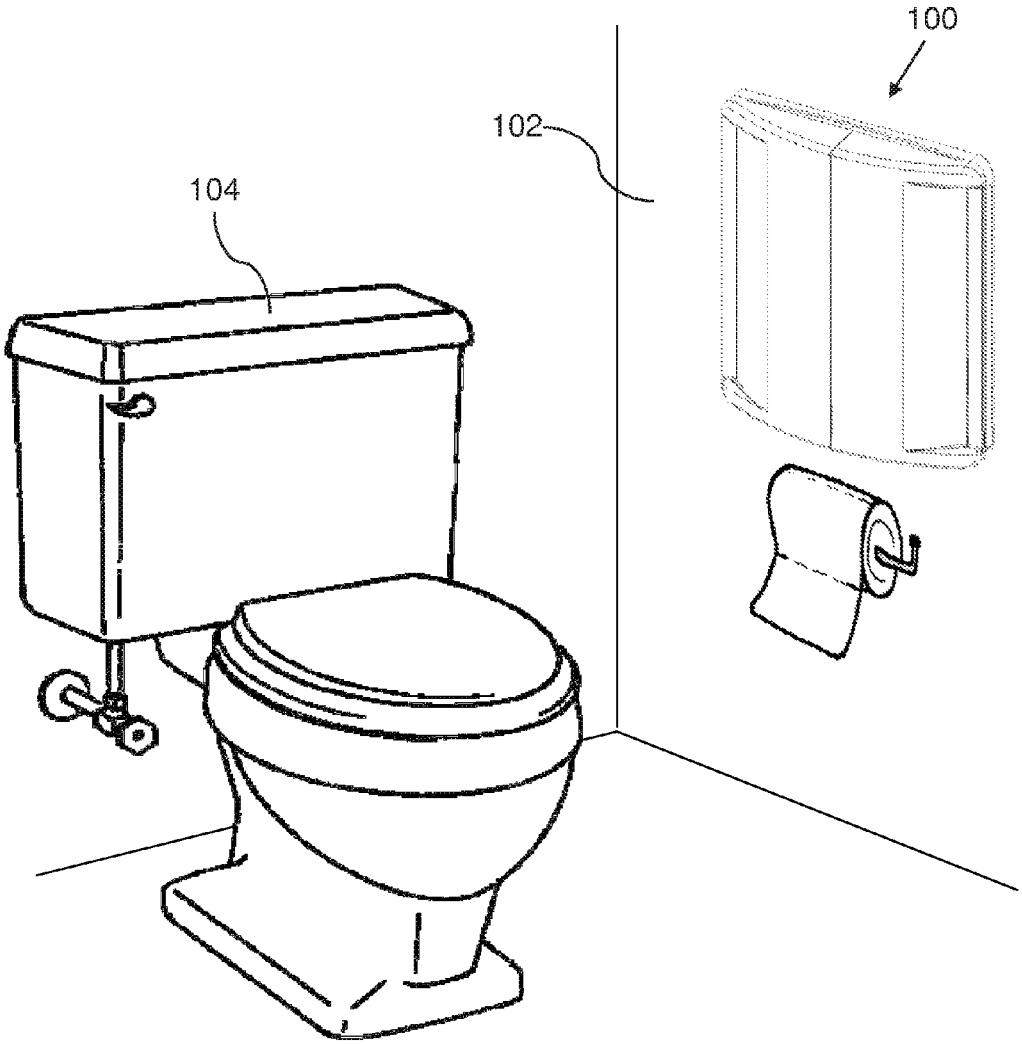
FIG. 1 shows a perspective view of a customizable wall cabinet that is installed on a wall, according to an embodiment of the invention.

Before describing the invention in detail, it should be observed that the present invention resides primarily in a novel and non-obvious combination of elements and process steps. So as not to obscure the disclosure with details that will readily be apparent to those skilled in the art, certain conventional elements and steps have been presented with lesser detail, while the drawings and specification describe in greater detail other elements and steps pertinent to understanding the invention.

The following embodiments are not intended to define limits as to the structure or method of the invention, but only to provide exemplary constructions. The embodiments are permissive rather than mandatory and illustrative rather than exhaustive.

In the following, we describe the structure of an embodiment of a customizable wall cabinet 100 with reference to FIG. 1, in such manner that like reference numerals refer to like components throughout; a convention that we shall employ for the remainder of this specification.

In an embodiment, as shown in FIG. 1, a customizable wall cabinet 100 for storage of personal items can be installed in a wall 102 next to a toilet 104, such that the customizable wall cabinet 100 is partially recessed into the wall 102.

Figure 2:
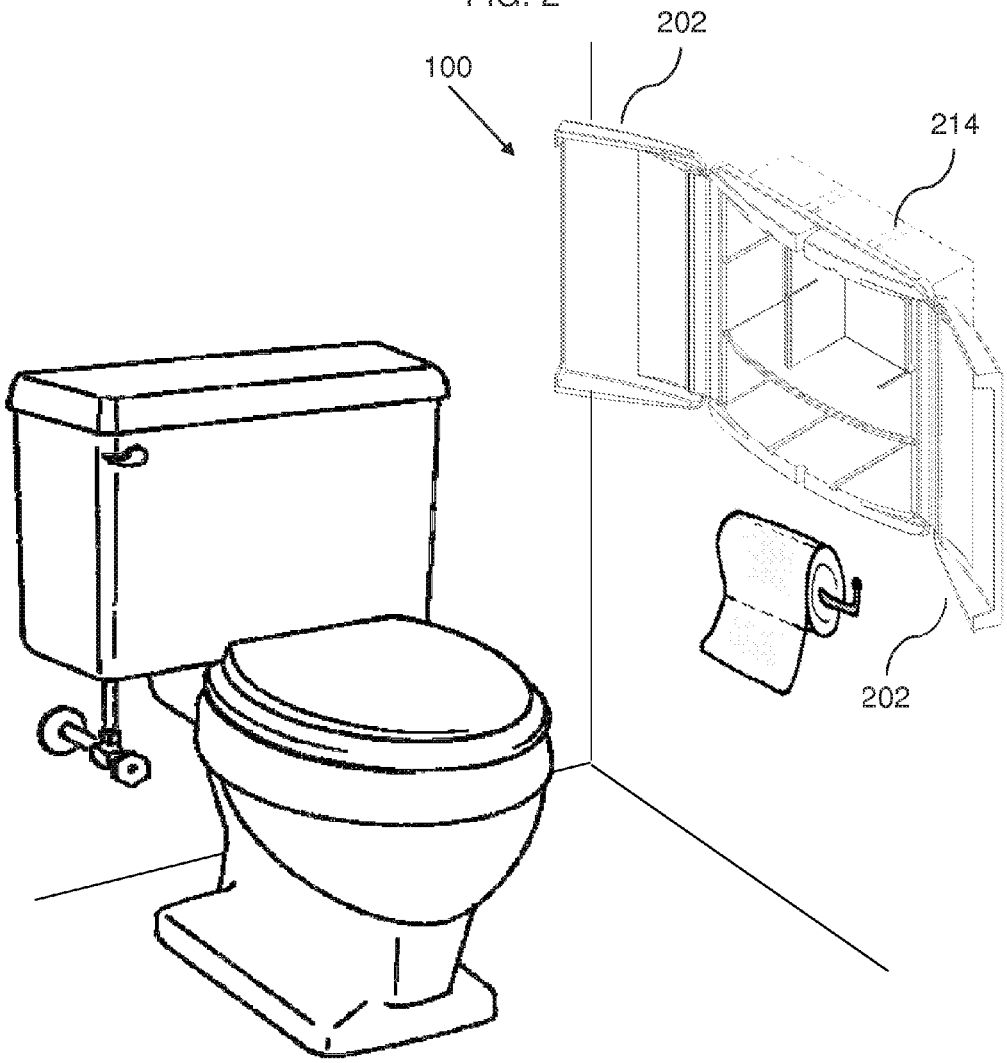
FIG. 2 shows a perspective view of a customizable wall cabinet that is installed on a wall, according to an embodiment of the invention.

FIG. 2 shows the embodiment shown in FIG. 1, wherein doors 202 of the customizable wall cabinet 100 are opened. A rear recessed part 214 of the customizable wall cabinet 100 is here shown inside the wall 102, illustrated in dotted lines.

Figure 3:
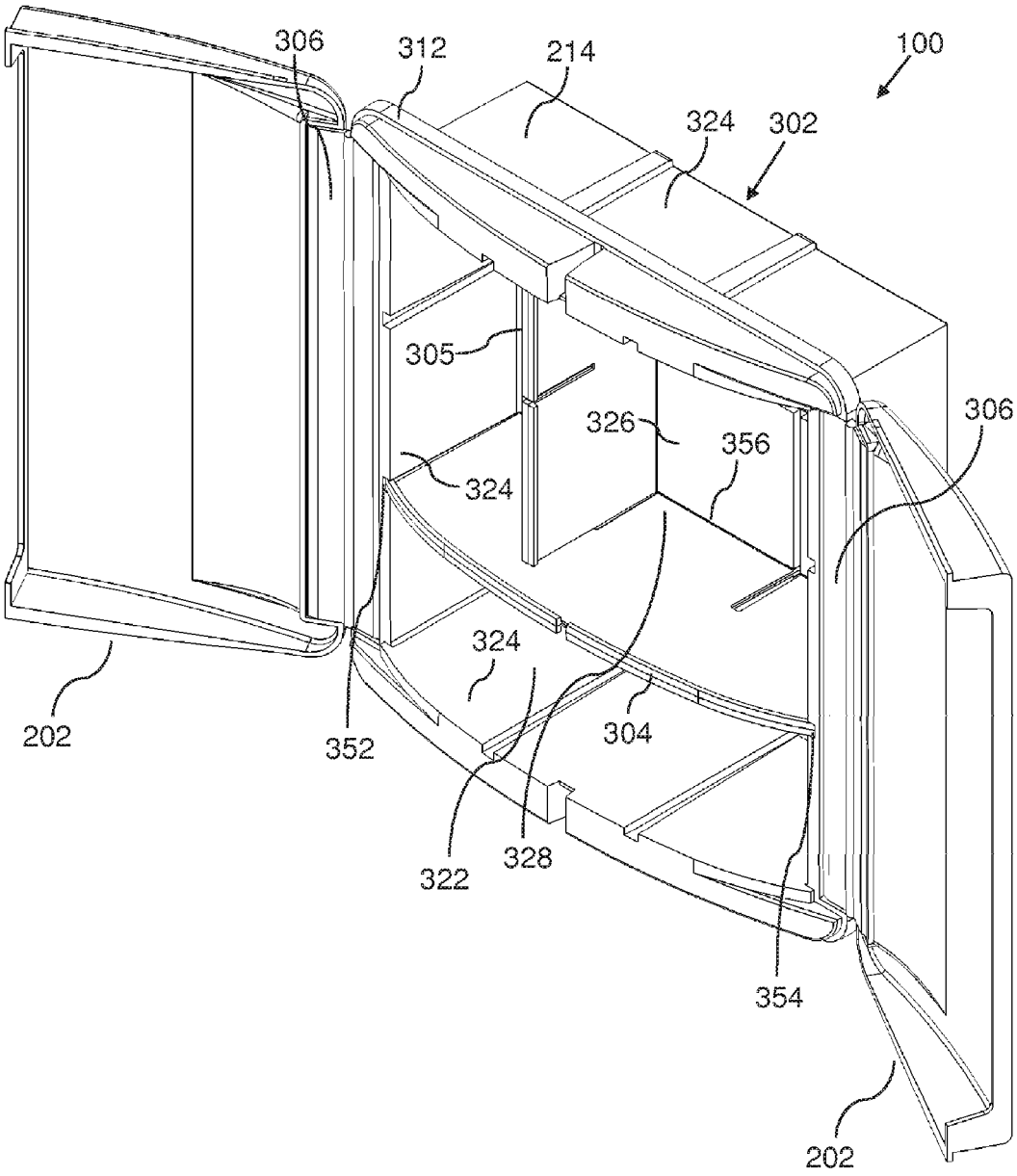
FIG. 3 shows a perspective view of a customizable wall cabinet, according to an embodiment of the invention.
Figure 8:
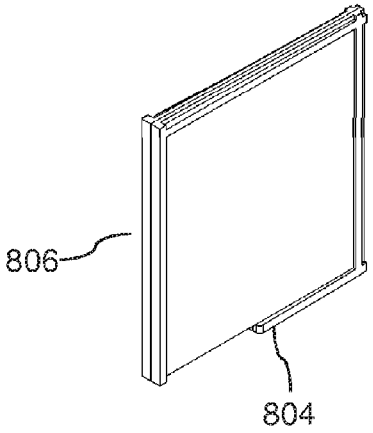
FIG. 8 shows a perspective view of a one-third divider for a customizable wall cabinet, according to an embodiment of the invention.

In an embodiment, as shown in FIG. 3, a customizable wall cabinet 100 for storage of personal items can include:

a) A body 302, which can include an opening 322 in a front, side walls 324, and a rear wall 326, such that the side walls 324 and the rear wall 326 define an interior 328 of the body with the opening 322 in the front; and b) Front doors 202, which can be rotationally mounted along a front of the left and right sides of the body 302, such that the doors for example can be mounted with hinges mounted to fronts of the right and left sides of the body 302;

c) Dividers 304, 305, which can include:

i. A full divider 304, which can be inserted and firmly positioned into an interior of the body 302, such that the full divider 304 is configured to slide into opposing side grooves 352 354 in the inner surfaces of the side walls 324 of the body 302, and fits into a horizontal rear groove 356, such that the rear groove 356 connects between the opposing grooves 352, 354;

ii. A two-thirds divider 305, which can be inserted and firmly positioned into an interior of the body 302, such that the two-thirds divider 305 fits between a full divider 304 and a side wall 324, and when fully inserted, fits into a vertical rear groove of the inner surface of the rear wall; and iii. A one-third divider 806, as shown in FIG. 8, which can be inserted and firmly positioned into an interior of the body 302, such that the one-third divider 806 fits between a full divider 304 and a side wall 324, and when fully inserted, fits into a vertical rear groove of the inner surface of the rear wall.

In related embodiments, the full divider 304, the two-thirds divider 305, and the one-third divider 806 can be inserted into the body 302 to form storage compartments, for example in combinations including:

a. No dividers at all;
b. One full divider 304;
c. Two full dividers 304;
d. One full divider 304 and one two-thirds divider 305;
e. One full divider 304 and two two-thirds dividers 305;
f. One full divider 304 and one one-third divider 806;
g. One full divider 304 and two one-third dividers 806; or
h. One full divider 304, one two-thirds divider 305, and one one-third divider 806.

In a related embodiment, the body 302 can further include:

a. A front part 312; and
b. A rear recessed part 214, such that the front part 312 is connected to a front of the rear recessed part 214;

wherein the front part 312 and the rear recessed part 214 can be separate components that are connected, or can be manufactured as a single piece.

Figure 12:
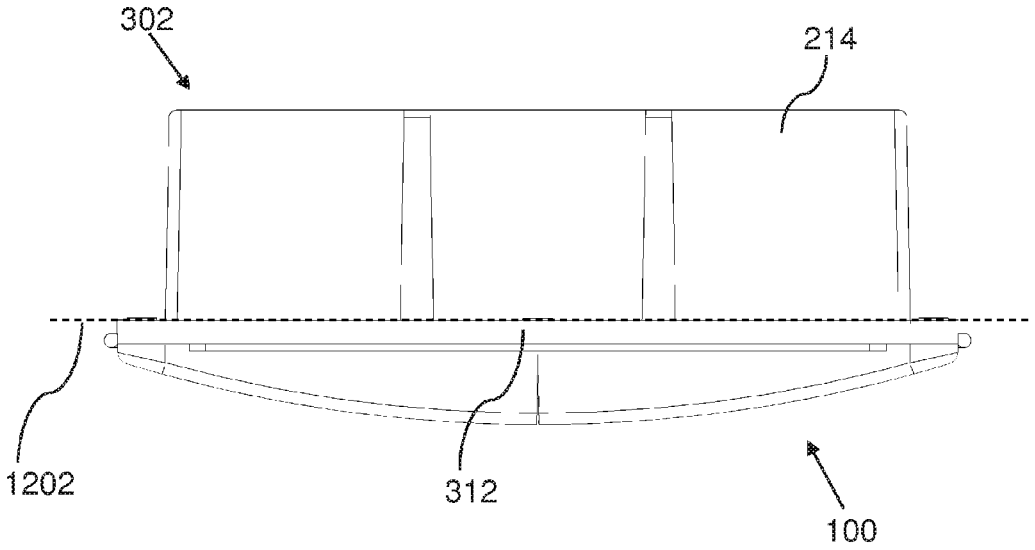
FIG. 12 shows a top view of a customizable wall cabinet, according to an embodiment of the invention.

FIG. 12 shows a top view of the customizable wall cabinet 100, showing the front part 312, and in the rear, behind the indication line 1202, the rear recessed part 214, wherein the front part 312 is configured to protrude to the sides and cover the insertion of the rear part 214 into a cavity in a wall, such that, as shown in FIG. 1, only the front part 312 is visible after installation.

In a related embodiment, the customizable wall cabinet 100 can further include right and left hinges 306, such that the hinges 306 connects from inner sides of right and left doors 202 to respectively left and right sides of the body 302, such that the right and left hinges 306 attaches the left and right doors 202 to the body 302, and functions as hinges. The hinges 306 allows each door 202 to be rotated open and closed manually by hand, wherein opening of the doors 202 can be aided by small, molded-in tabs at the top and bottom of each door 202.

Figure 13:
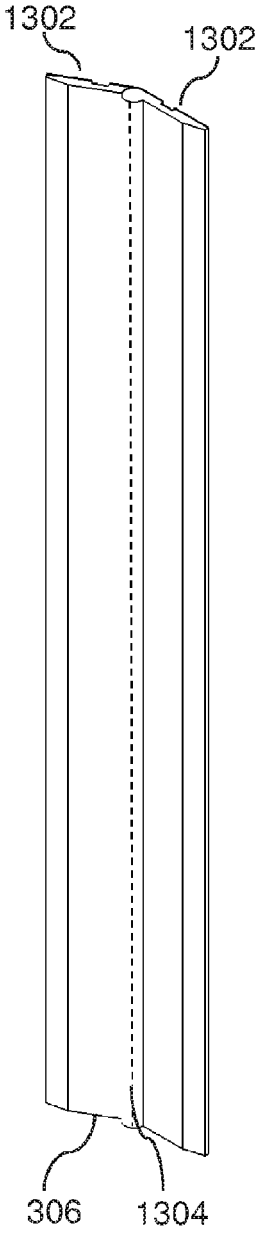
FIG. 13 shows a perspective view of a hinge in an open configuration, according to an embodiment of the invention.

In a related embodiment, as shown in FIG. 13, a hinge 306, here shown in an open configuration, can be an elongated piece, which can include two hinge flanges 1302, which are rotationally connected along a hinge crease 1304. The hinge 306 can be made of plastic and molded in one piece.

Figure 14:
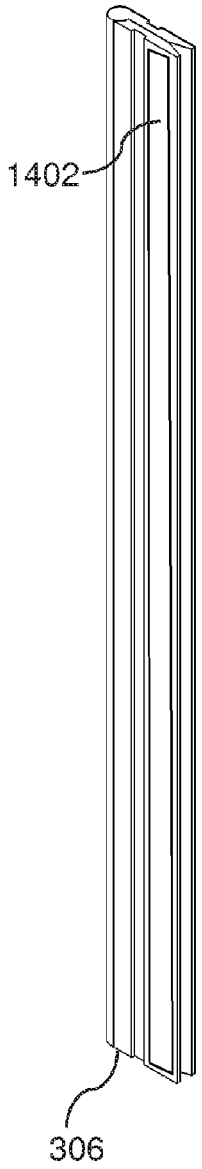
FIG. 14 shows a perspective view of a hinge in a closed configuration, according to an embodiment of the invention.

In a related embodiment, as shown in FIG. 14, a hinge 306, here shown in a closed configuration, can include hinge tape 1402 for attaching the hinge 306 to a door 202 and the body 302.

Figure 11:
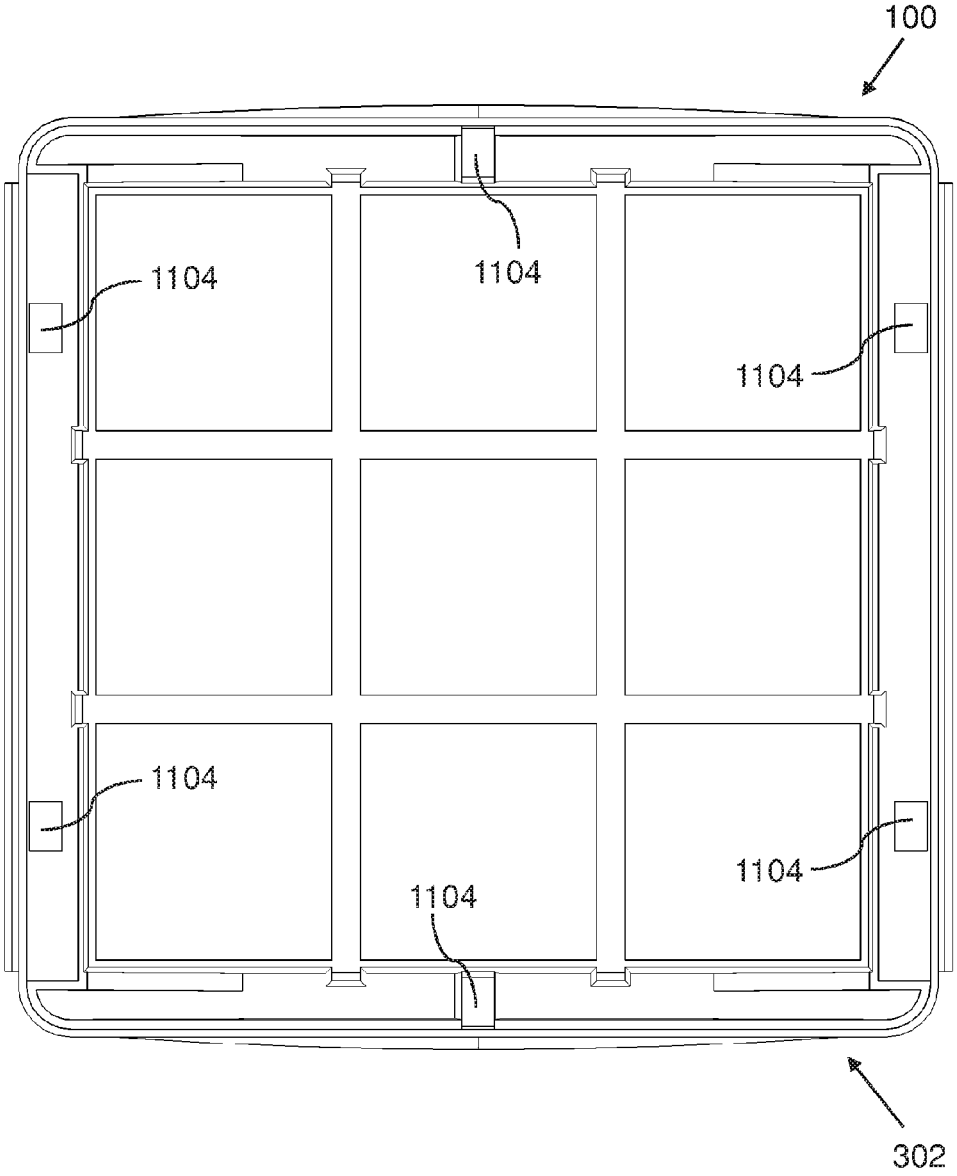
FIG. 11 shows a rear view of a customizable wall cabinet, according to an embodiment of the invention.

In a related embodiment, as shown in FIG. 11, at least one piece of mounting tape 1104 can be applied to a rear outer surface of the body 302, to securely hold the customizable wall cabinet 100 in a hole in the wall at the desired installation location. Mounting tape 1104 can for example be in the form of a patch of double-sided pressure-sensitive tape that is coated with adhesive on both sides of a carrier material.

Figure 4:
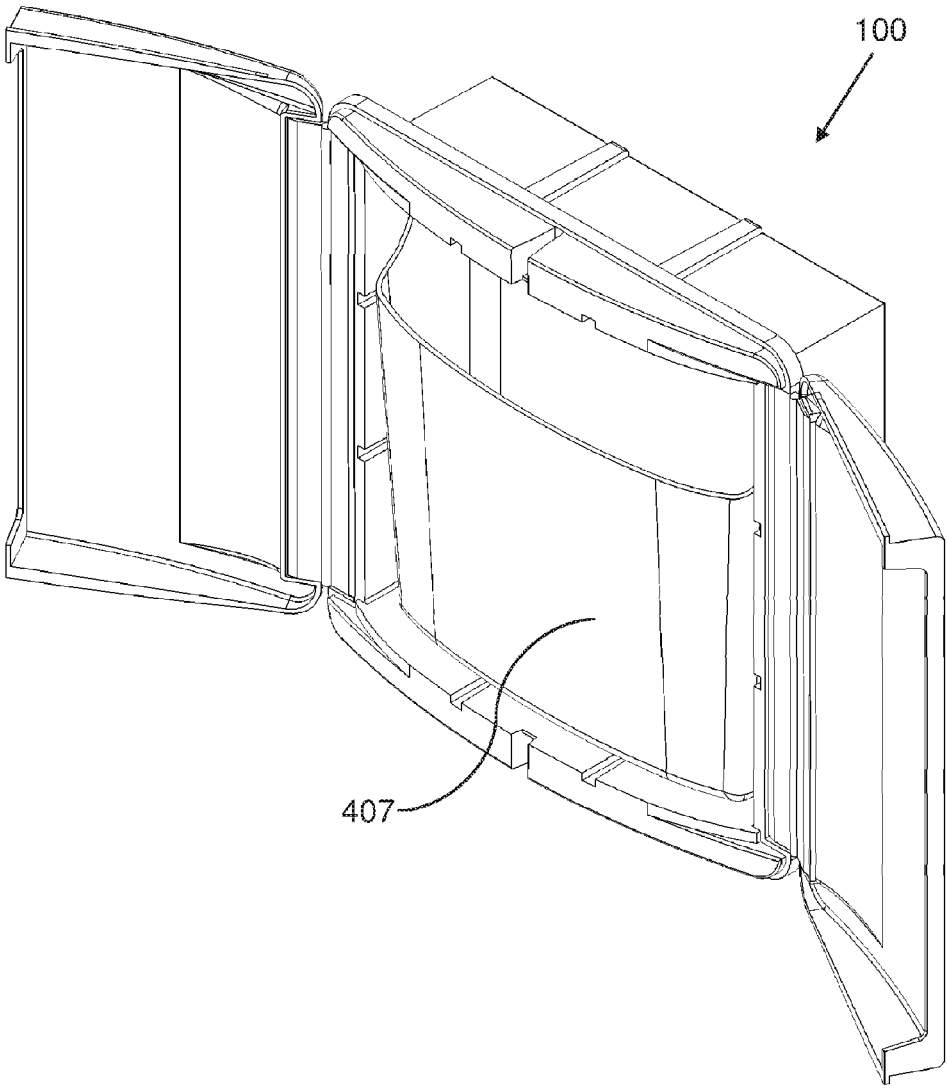
FIG. 4 shows a perspective view of a customizable wall cabinet, according to an embodiment of the invention.

In a related embodiment, as shown in FIG. 4, a trash pail 407 may be inserted into the interior of the body 302, in place of dividers 304 305.

In a related embodiment, the doors 202 can be opened and closed for various purposes, including:

a. configuring or reconfiguring compartments;

b. stocking items;

c. removing stored items; and d. inserting and removing the trash pail 407.

In a related embodiment, the mounting tape 1104 secures the customizable wall cabinet 100 to a wall, such that the customizable wall cabinet 100 is inserted into a hole or cutout made in the wall, such that the hole has a size that is matched to the rear recessed part 214 of the customizable wall cabinet 100.

In a related embodiment, the customizable wall cabinet 100 may be used without the full divider 304, the two-thirds divider 305, or the trash pail 407.

In a related embodiment, the customizable wall cabinet 100 provides enclosed, useable storage volume without those components.

In a related alternative embodiment, the full divider 304, the two-thirds divider 305, and the one-third divider 806 may be inserted into the body 302 to divide the storage volume into compartments. The two-thirds divider 305 and the one-third divider 806 can only be used when a full divider 304 has been inserted.

Figure 6:
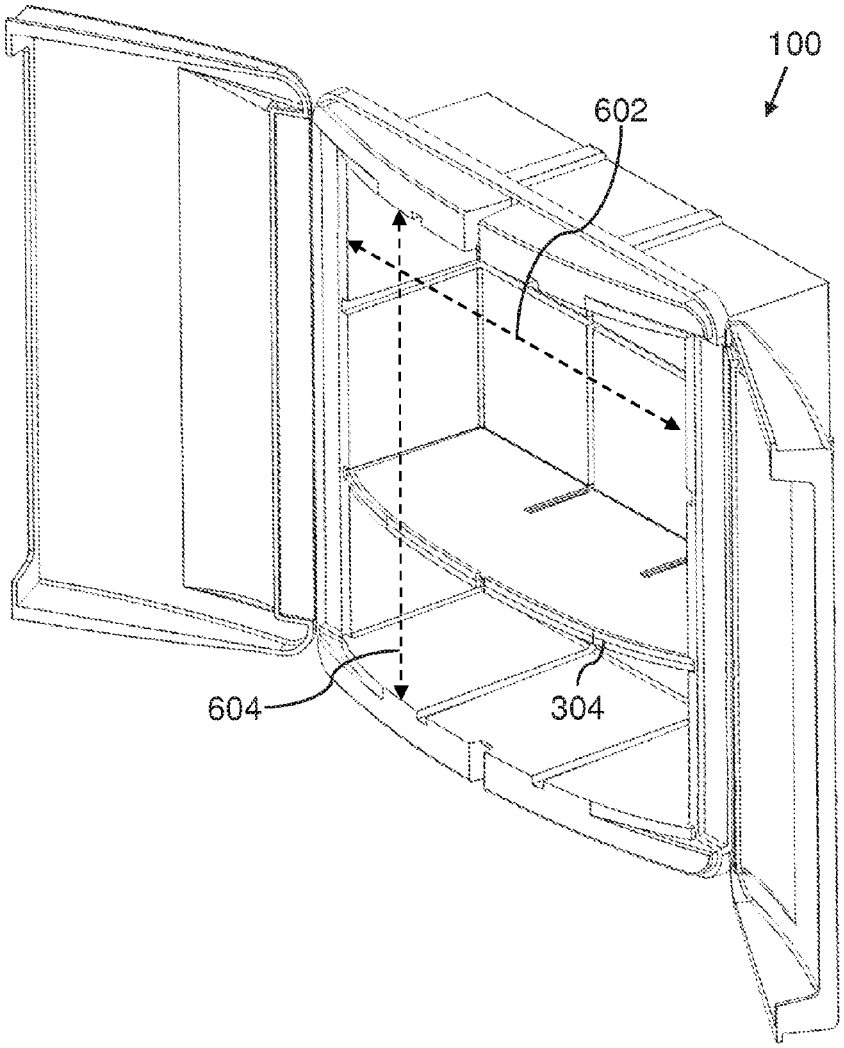
FIG. 6 shows a perspective view of a customizable wall cabinet, according to an embodiment of the invention.

In a related embodiment, the opening 322 can be square, such that a width 602 and height 604 of the opening 322 are equal, and such that there is a uniform and similar distance between opposing vertical side walls 324 and opposing horizontal side walls 324, in the interior 328 of the body 302. The width 602 and height 604 are indicated in FIG. 6.

Figure 5:
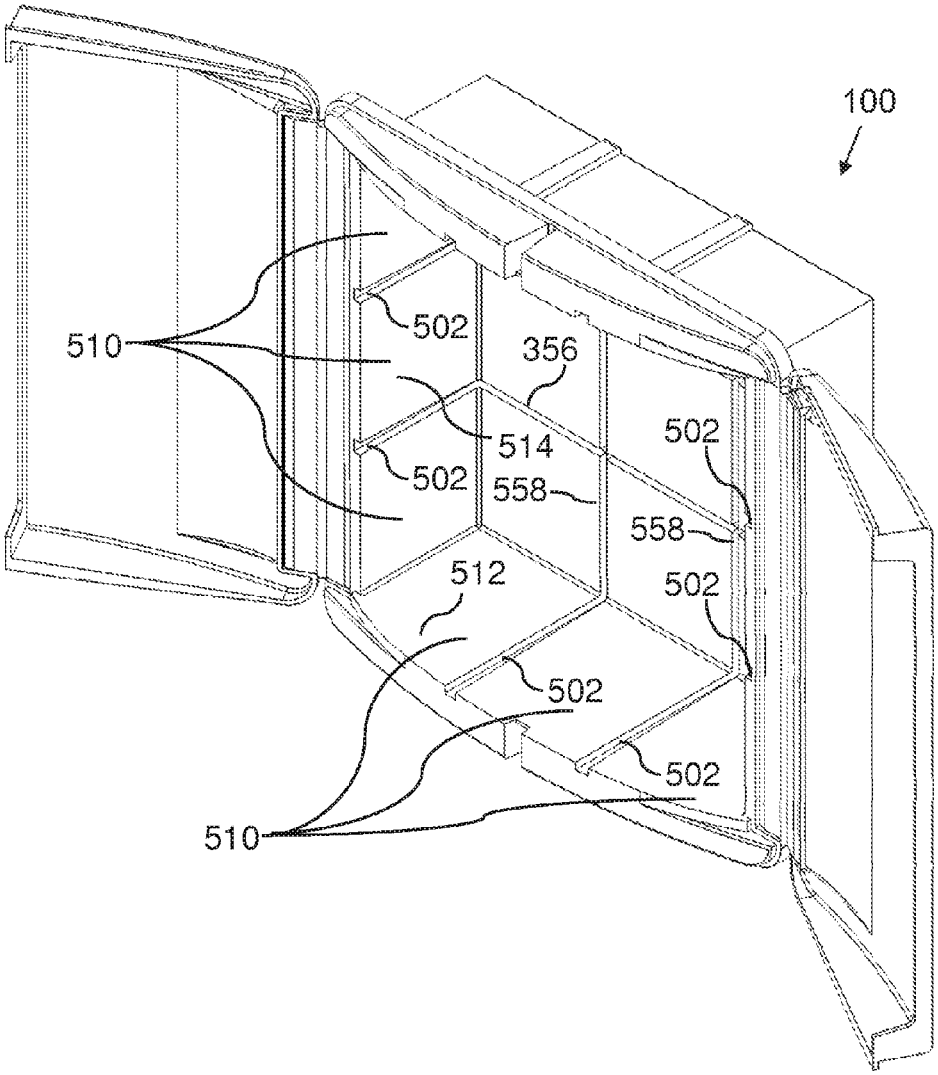
FIG. 5 shows a perspective view of a customizable wall cabinet, according to an embodiment of the invention.

In a related embodiment, wherein the opening 322 is square, the full divider 304 can be inserted by itself, vertically or horizontally, such that the full divider 304 slides into side grooves 502, as shown in FIG. 5, on inner surfaces of the body 302, such that:

a. When inserted vertically, the full divider 304 divides the storage volume into two compartments (left and right). One compartment is approximately one third of the storage volume, and the other compartment contains the remaining two thirds.

b. When inserted horizontally, the full divider 304 not only divides the storage volume into two compartments (top and bottom), but also acts as a shelf.

In a related embodiment, such as shown in FIG. 5, the side grooves 502 can be perpendicular to a plane of the opening, such that there are two side grooves for each horizontal side or vertical side, wherein each side is divided into 3 segments 510 of equal width. Horizontal sides 512 have an upper horizontal side (not visible in FIG. 5) and a lower horizontal side 512. Vertical sides have a right vertical side 514 and a left vertical side (not visible in FIG. 5).

In a further related embodiment, there can be two horizontal rear grooves 356, which connect opposing side grooves 502 in vertical sides, and two vertical rear grooves 558, which connect opposing side grooves 502 in horizontal sides.

In a further related embodiment, the grooves 502 can be molded-in to inner surfaces of the body 302, or can be additional elements that are attached onto inner surfaces of the body 302, to form a slot or groove.

In a related embodiment, the full divider 304 and two-thirds divider 305 may be used together to divide the storage volume into three compartments, with each compartment of different size. The full divider 304 and two-thirds divider 305 interlock at a ninety-degree angle, and are inserted into the grooves 502 of the body 302. The user selects the orientation of the interlocked dividers according to the molded-in grooves and the desired configuration of compartments. The full divider 304 and two-thirds divider 305 may be removed, disassembled, and re-inserted at any time.

In a related embodiment, the full divider 304 and one-thirds divider 806 may be used together to divide the storage volume into three compartments, with each compartment of different size. The full divider 304 and one-thirds divider 806 interlock at a ninety-degree angle, and are inserted into the grooves 502 of the body 302. The user selects the orientation of the interlocked dividers according to the molded-in grooves and the desired configuration of compartments. The full divider 304 and one-thirds divider 806 may be removed, disassembled, and re-inserted at any time.

In a related embodiment, the dividers 304, 305, 806 are not permanently joined to each other, nor are they permanently joined to the body 302 or any other element. The design of the dividers and their installation method provides flexibility for reconfiguration or removal, and also ensures stability.

In a related embodiment, the trash pail 407 may be inserted into the body 302 in lieu of one or more dividers 304, 305, 806. The trash pail 407 can be removed and reinserted at any time, and is not permanently joined to the body 302 or any other element.

In a further related embodiment, the trash pail 407 slides into and out of the body 302, and its outer dimensions can be configured to ensure the trash pail 407 will not tip over or fall out.

In a related embodiment, with respect to depositing of trash items in the trash pail 407:

a. For small items, the shape and dimensions of the trash pail 407 enables a user to open one or both of the doors 202 and place the item into the trash pail 407 without partial removal, full removal, tilt, or rotation of the trash pail 407.

b. For larger items, which are small enough to fit within the trash pail 407 volume, the pail 407 may be partially or fully removed from the body 302, and then the item may be deposited into the trash pail 407. The trash pail 407 may then be reinserted into the body 302.

In a related embodiment, when the trash pail 407 is removed, its contents can be easily disposed of by emptying the trash pail 407 into a larger trash bin or bag. Alternatively, a liner can be placed inside the trash pail 407, and that liner and its contents can then later be removed and similarly disposed of. The liner can be of a user's choice and may be placed into the trash pail 407 with the upper portion folded over the top edges of the trash pail 407 if desired. The size and shape of the trash pail 407 enables use of ordinary grocery store plastic bags as liners.

In a related embodiment, proper insertion of the full divider 304, two-thirds divider 305, one-third divider 806, and/or the trash pail 407 enables the doors 202 to rotate to their fully closed position. Neither the full, two-thirds, or one-third dividers 304, 305, 806, nor the trash pail 407, interfere with the operation of the doors 202.

In a related embodiment, the body 302, the doors 202, and the dividers 304, 305, 806 of the customizable wall cabinet 100 can be manufactured in plastic, for example by plastic injection molding.

In a related embodiment, the design of the customizable wall cabinet 100 can use constant-thickness walls for each element, where possible, to minimize warping that could otherwise occur during the cooling stage of the injection molding process.

In a related embodiment, the procured and manufactured elements are assembled using hinge tape to adhere the doors 202 to a hinge 306, and the door/hinge assemblies to the body 302.

In a related embodiment, when assembled and installed, the body 302, doors 202, mounting tape 1104, and hinges 306 form an enclosed, partially-recessed, single storage compartment within reach of a person using a toilet.

In a related embodiment, two full-sized dividers 304 can be installed in the body 302.

In a related alternative embodiment, one full divider 304 and two two-thirds dividers 305 can be installed inside the body 302.

In various related embodiments the customizable wall cabinet 100, can be used in methods of use, such that:

a. A person would install the customizable wall cabinet 100 in their preferred location; that location ordinarily being within reach while sitting on the toilet. The person would configure the customizable wall cabinet 100 per their intended configuration (storage or trash receptacle), including installation of one or more of the dividers if desired;

b. In the case of using the customizable wall cabinet 100 for storage of personal items, the person would open the doors 202, stock the customizable wall cabinet 100 with the type and quantity of preferred items, and close the doors afterward;

c. When using the toilet, the person would open one or both doors to remove and use any item(s) of choice stored in the customizable wall cabinet 100. The person would close any open door(s) 202 when done;

d. In the case of using the customizable wall cabinet 100 as an enclosed trash receptacle, the person would open one or both doors 202 and place items for disposal into the trash pail 407;

e. Optionally, the person may line the trash pail in advance with a liner of choice. This could be an ordinary grocery store plastic bag if desired;

f. When the trash pail is full, or at any time desired, the person may open both doors 202 and remove the trash pail 407;

g. The contents of the pail 407, including a liner if used, may then be disposed of via emptying into a larger trash bin or bag. A new liner may then be installed in the trash pail if desired. The trash pail 407 is then re-inserted into the body of the customizable wall cabinet 100, and the doors closed; and/or h. The customizable wall cabinet 100, while intended primarily for installation and use by a person sitting on a toilet, can be installed and used at a location not within reach of a toilet. That alternative location can be elsewhere in the water closet, elsewhere in the restroom outside the water closet area, or anywhere else for which sufficient space exists between wall studs.

In a related embodiment, items stored or trash deposited in the customizable wall cabinet 100 need not necessarily be constrained to personal toiletries associated with the water closet.

In a related embodiment, FIG. 6 shows a customizable wall cabinet 100 with one full divider 304 installed.

Figure 7:
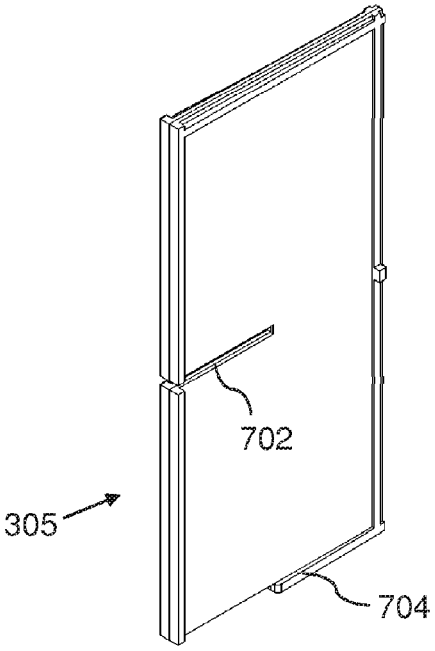
FIG. 7 shows a perspective view of a two-thirds divider for a customizable wall cabinet, according to an embodiment of the invention.

In a related embodiment, FIG. 7 shows a two-thirds divider 305, with a front mounted half-slit 702, and a slit-connector 704 in a bottom rear end of the two-thirds divider 305, such that the slit-connector 704 can be an elongated protrusion that can fit into a slit in order to connect the two-thirds divider 305.

In a related embodiment, FIG. 8 shows a one-third divider 806, with a slit-connector 804 in a bottom rear end of the one-third divider 806, such that the slit-connector 804 can be an elongated protrusion that can fit into a slit in order to connect the one-third divider 806.

Figure 9:
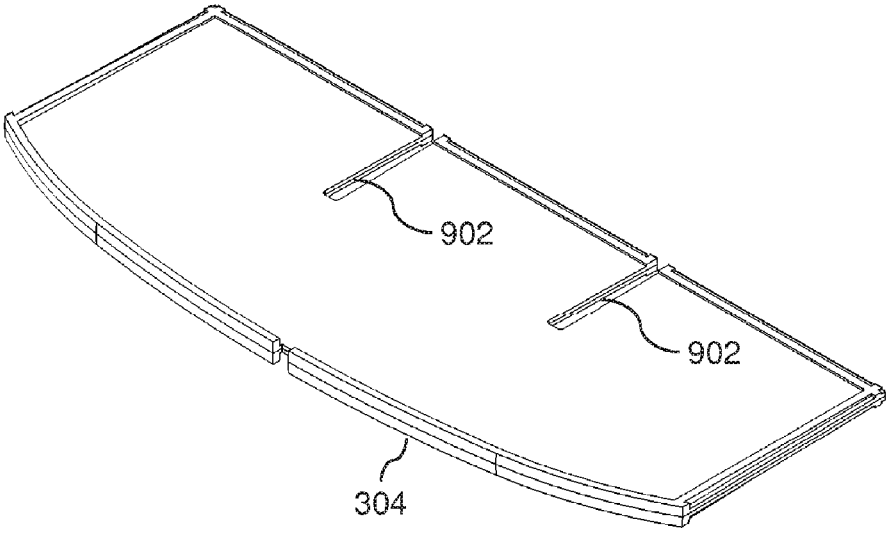
FIG. 9 shows a perspective view of a full divider for a customizable wall cabinet, according to an embodiment of the invention.

In a related embodiment, FIG. 9 shows a full divider 304, with rear mounted half-slits 902, such that the rear mounted half-slits 902 can interconnect with a front mounted half-slit 702 of a two-thirds divider 305.

Figure 10:
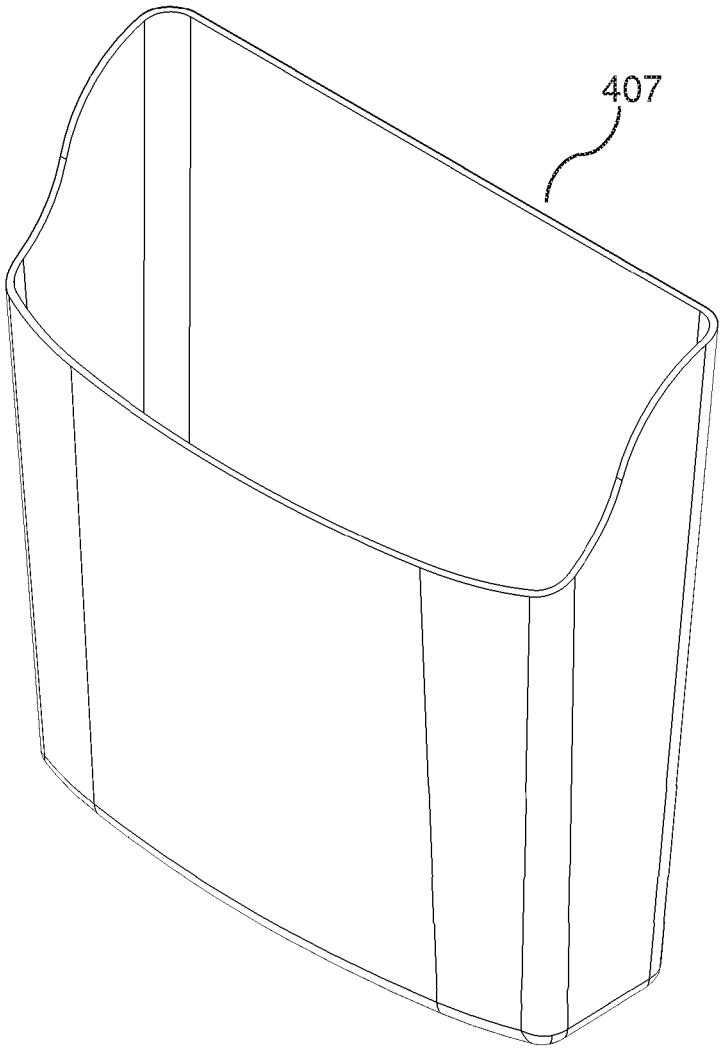
FIG. 10 shows a perspective view of a trash pail for a customizable wall cabinet, according to an embodiment of the invention.

In a related embodiment, FIG. 10 shows a perspective view of a trash pail 407.

Here has thus been described a multitude of embodiments of the customizable wall cabinet 100, and methods related thereto, which can be employed in numerous modes of usage.

The many features and advantages of the customizable wall cabinet 100 are apparent from the detailed specification, and thus, it is intended by the appended claims to cover all such features and advantages of the customizable wall cabinet 100, which fall within the true spirit and scope of the customizable wall cabinet 100.

Many such alternative configurations are readily apparent, and should be considered fully included in this specification and the claims appended hereto. Accordingly, since numerous modifications and variations will readily occur to those skilled in the art, it is not desired to limit the customizable wall cabinet 100 to the exact construction and operation illustrated and described, and thus, all suitable modifications and equivalents may be resorted to, falling within the scope of the customizable wall cabinet 100.

What is claimed is:

1. A customizable wall cabinet for storage of personal items, comprising:

a. a body, further comprising:
   an opening in a front of the body;
   side walls, further comprising opposing side grooves; and
   a rear wall, further comprising a rear groove of an inner surface of the rear wall; and b. a full divider, which is inserted and firmly positioned into an interior of the body, such that the full divider is configured to slide into the opposing side grooves, and fits into the rear groove, such that the rear groove connects between the opposing side grooves; and c. a two-thirds divider, which is inserted and firmly positioned into the interior of the body, such that the two-thirds divider fits between the full divider and a side wall, and when fully inserted, fits into the rear groove.

2. The customizable wall cabinet of claim 1, further comprising:

front doors, which are rotationally mounted along left and right front sides of the body.

3. The customizable wall cabinet of claim 1, further comprising:

a one-third divider, which is inserted and firmly positioned into the interior of the body, such that the one-third divider fits between the full divider and a side wall, and when fully inserted, fits into the rear groove.

4. The customizable wall cabinet of claim 3, wherein the one-third divider further comprises:

a slit-connector, which is positioned in a bottom rear end of the one-third divider, such that the slit-connector is an elongated protrusion;

wherein the full divider further comprises at least one front mounted half-slit;

wherein the slit-connector fits into the at least one front mounted half-slit, in order to connect the one-third divider.

5. The customizable wall cabinet of claim 1, wherein the body further comprises:

a. a front part; and b. a rear recessed part;

wherein the front part is connected to a front of the rear recessed part;

wherein the front part is configured to protrude to the sides, whereby the front part covers insertion of the rear recessed part into a cavity in a wall.

6. The customizable wall cabinet of claim 1, further comprising:

a. a right hinge;

b. a left hinge;

c. a right door; and d. a left door wherein the right hinge connects from a right inner side of the right door to a front of a right side of the body;

wherein the left hinge connects from a left inner side of the left door to a front of a left side of the body;

such that the right and left hinges attach the left and right doors to the body.

7. The customizable wall cabinet of claim 1, further comprising:

at least one piece of mounting tape;

wherein the mounting tape is applied to a rear outer surface of the body, whereby the mounting tape securely holds the customizable wall cabinet in a hole in the wall at a desired installation location.

8. The customizable wall cabinet of claim 1, further comprising:

a trash pail, which is inserted into an interior of the body.

9. The customizable wall cabinet of claim 1, wherein the opening is square.

10. The customizable wall cabinet of claim 1, wherein the side grooves are perpendicular to a plane of the opening.

11. The customizable wall cabinet of claim 10, wherein the side grooves comprise two side grooves for each horizontal side and two side grooves for each vertical side, such that each side is divided into 3 segments of equal width.

12. The customizable wall cabinet of claim 1, further comprising rear groves of the inner surface of the rear wall, wherein the rear grooves comprise a. two horizontal rear grooves, which connect opposing side grooves in vertical sides; and b. two vertical rear grooves, which connect opposing side grooves in horizontal sides.

13. The customizable wall cabinet of claim 1, wherein the full divider further comprises at least one rear mounted half-slit.

14. The customizable wall cabinet of claim 13, wherein the two-thirds divider further comprises:

at least one front mounted half-slit;

wherein the front mounted half-slit is configured to interconnect with the rear mounted half-slit of the full divider.

15. The customizable wall cabinet of claim 14 wherein the two-thirds divider further comprises:

a slit-connector, which is positioned in a bottom rear end of the two-thirds divider, such that the slit-connector is an elongated protrusion;

wherein the slit-connector fits into the at least one front mounted half-slit, in order to connect the two-thirds divider.

16. A customizable wall cabinet for storage of personal items, comprising:

a. a body, further comprising:

an opening in a front of the body;

side walls, further comprising opposing side grooves; and a rear wall, further comprising a rear groove of an inner surface of the rear wall; and b. a full divider, which is inserted and firmly positioned into an interior of the body, such that the full divider is configured to slide into the opposing side grooves, and fits into the rear groove, such that the rear groove connects between the opposing side grooves; and c. a one-third divider, which is inserted and firmly positioned into the interior of the body, such that the one-third divider fits between the full divider and a side wall, and when fully inserted, fits into the rear groove.

17. A customizable wall cabinet for storage of personal items, comprising:

a. a body, further comprising:

an opening in a front of the body;

side walls, further comprising side grooves; and a rear wall, further comprising a rear groove of an inner surface of the rear wall;

wherein the side grooves are perpendicular to a plane of the opening; and wherein the side grooves comprise two side grooves for each horizontal side and two side grooves for each vertical side, such that each side is divided into 3 segments of equal width.

18. A customizable wall cabinet for storage of personal items, comprising:

a. a body, further comprising:

an opening in a front of the body;

side walls, further comprising side grooves; and a rear wall, further comprising rear grooves of an inner surface of the rear wall;

wherein the rear grooves comprise:

two horizontal rear grooves, which connect opposing side grooves in vertical sides; and two vertical rear grooves, which connect opposing side grooves in horizontal sides.

* * * * *